US006910866B2

(12) United States Patent
Bassot et al.

(10) Patent No.: US 6,910,866 B2
(45) Date of Patent: Jun. 28, 2005

(54) CONTROLLING THE AXIAL POSITION OF A FAN BLADE

(75) Inventors: Alain Bassot, Bois-Le Roi (FR); Jean-Claude Bonny, Voisenon (FR); Philippe Even, Vernon (FR); Pierre Lamothe, Saint-Paul/Save (FR); Alain Madec, Chartrettes (FR); Patrick Reghezza, Vaux le Penil (FR)

(73) Assignee: Snecma Moteurs, Paris (FR)

( * ) Notice: Subject to any disclaimer, the term of this patent is extended or adjusted under 35 U.S.C. 154(b) by 0 days.

(21) Appl. No.: 10/659,290

(22) Filed: Sep. 11, 2003

(65) Prior Publication Data

US 2004/0126240 A1 Jul. 1, 2004

(30) Foreign Application Priority Data

Sep. 18, 2002 (FR) ..... 02 11539

(51) Int. Cl.[7] ..... F01D 5/32
(52) U.S. Cl. ..... 416/221; 416/220 R
(58) Field of Search ..... 416/219 R, 220 R, 416/221

(56) References Cited

U.S. PATENT DOCUMENTS 4,033,705 A 7/1977 Luebering
4,405,285 A * 9/1983 Surdi ..... 416/220 R
4,523,890 A * 6/1985 Thompson ..... 416/221
5,259,728 A 11/1993 Szpunar et al.
5,282,720 A 2/1994 Szpunar
5,540,552 A * 7/1996 Surdi ..... 416/220 R
6,595,755 B2 * 7/2003 Brioude et al. ..... 416/220 R

FOREIGN PATENT DOCUMENTS

EP 0 690 203 A2 1/1996
FR 2561307 A * 9/1985 ..... 416/220 R
GB 2 262 139 A 6/1993

* cited by examiner

*Primary Examiner*—Christopher Verdier
(74) *Attorney, Agent, or Firm*—Oblon, Spivak, McClelland, Maier & Neustadt, P.C.

(57) ABSTRACT

A fan rotor includes a disk having a rim with a plurality of substantially axial grooves that are spaced apart angularly. Removable blades extend radially outwards from the periphery of the disk. Each blade has a blade root in a respective groove. A downstream flange plate can be secured to the disk with the downstream faces of the blade roots being in abutment against the downstream flange plate. An upstream flange plate is secured to the disk so as to retain the blade roots in the grooves. In the rotor, the upstream flange plate is fitted on its downstream face with a resilient device configured to exert sufficient force on the upstream faces of the blade roots, after assembly, to prevent an axial displacement of the blades during normal operation (apart from exceptional events of the type in which foreign bodies are ingested or blades are lost).

20 Claims, 2 Drawing Sheets

FIG.1
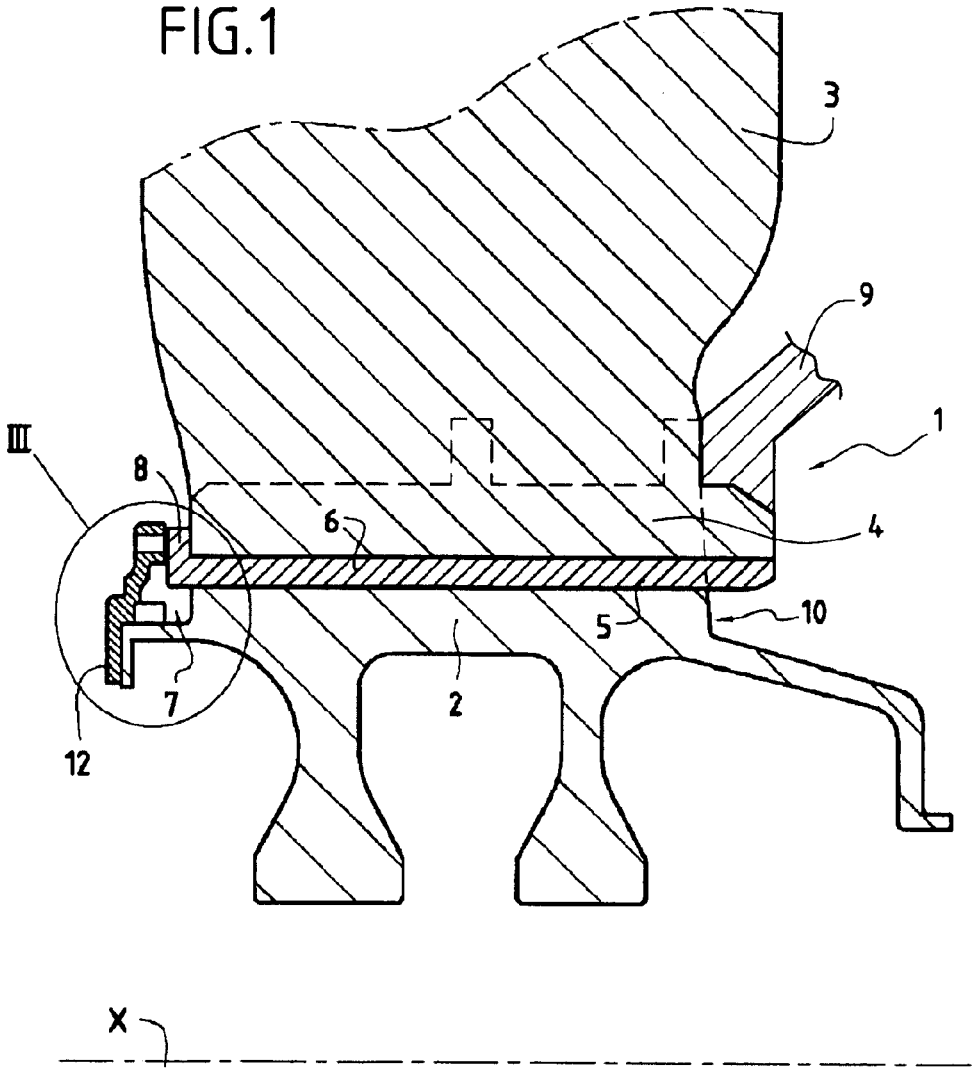
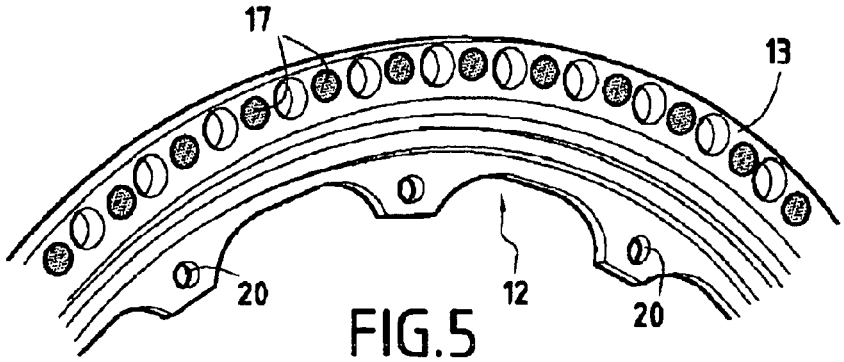
FIG.5

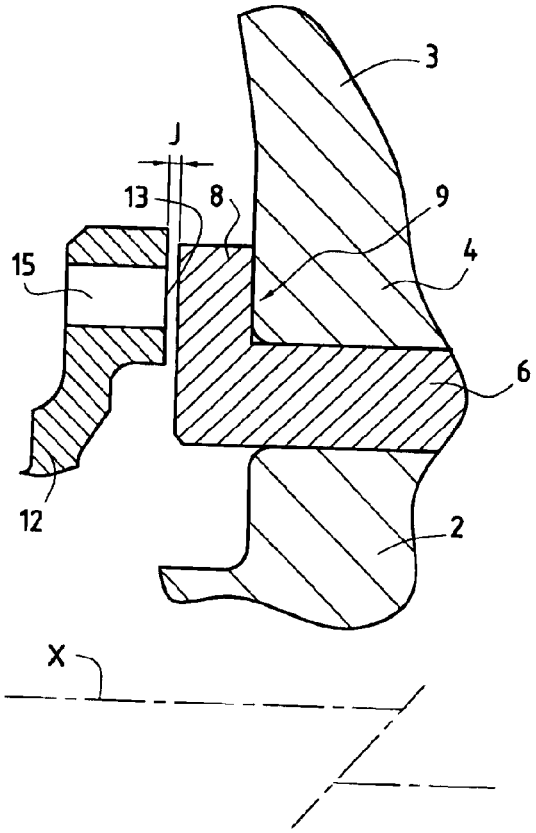
FIG.2
FIG.3
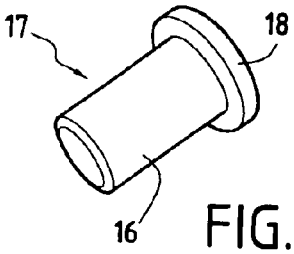
FIG.4A
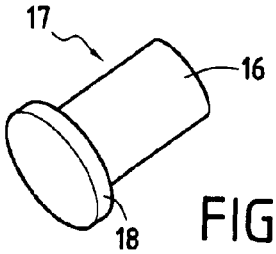
FIG.4B
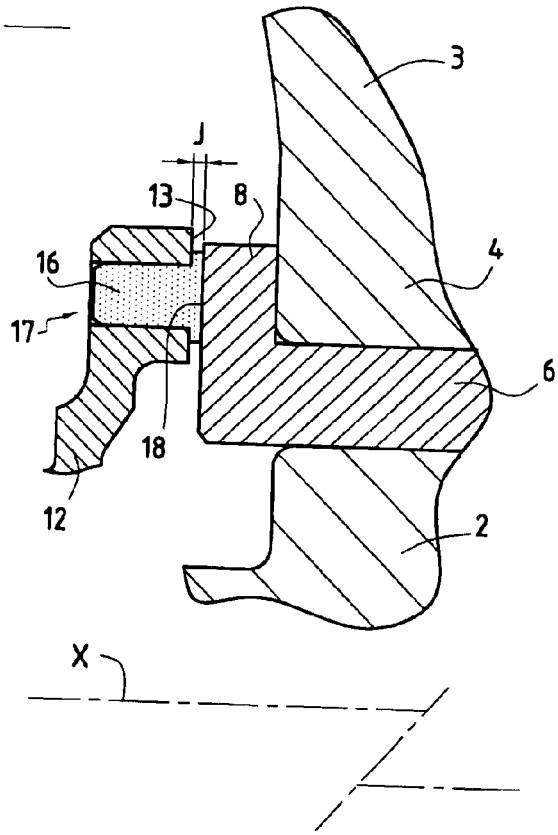

CONTROLLING THE AXIAL POSITION OF A FAN BLADE

FIELD OF THE INVENTION

The invention relates to a system for controlling the axial position of removable blades in a turbojet fan.

More precisely, the invention relates to a fan rotor comprising a disk having a rim with a plurality of substantially axial grooves that are regularly spaced apart angularly, a plurality of removable blades extending radially outwards from the periphery of said disk, each blade having a blade root received in a respective groove, a downstream flange plate secured to said disk with the downstream faces of the blade roots being in abutment there against, and a removable upstream flange plate secured to said disk for the purpose of retaining the blade roots in the grooves.

In the present text, the "upstream face" designates the face facing towards the front of the engine and the "downstream face" designates the face facing towards the rear.

BACKGROUND OF THE INVENTION

The upstream flange plate of a fan rotor is generally removable so as to enable a blade to be replaced in the event of damage. This can occur in the event of foreign bodies, such as birds, being ingested, in particular during the takeoff and approach stages of an aircraft fitted with turbojets.

For assembly reasons, axial clearance is included in the connection between a blade and the disks. The random axial position of a fan blade within this clearance unbalances the rotor and generates vibration in operation. This is particularly true for fan blades that are of large chord.

The large centrifugal forces to which blades are subjected in operation can also lead to blades being moved axially in random manner within said assembly clearance.

U.S. Pat. No. 4,033,705 discloses a system for retaining blades axially, which system comprises, at each end of a blade root, a tenon which co-operates with two oblique mortises arranged in the rim of the disk on either side of the groove receiving the blade root. The tenons provided on each face of the disk are held radially by a ring secured to the disk. Between each end face of the blade root and the adjacent tenon, that document provides for spring-forming sheet metal acting to prevent the tenon from moving radially while the blades are being assembled, prior to the retaining ring being put into place and fastened. Those springs create assembly clearance at each end of a blade, as can be seen in FIG. 7 of that document, which clearance is not under control.

U.S. Pat. No. 5,282,720 provides for interposing honeycomb elements between the retaining flange plates and the ends of the blade roots, the honeycomb elements serving to absorb a portion of the energy in the event of birds being ingested. During ingestion, the honeycomb deforms progressively, thereby dissipating a portion of the energy. The honeycomb elements must retain their integrity during assembly of the flange plates, and as a result there inevitably exists some axial clearance after assembly, thereby making random axial displacement possible while the fan is in operation.

OBJECT AND SUMMARY OF THE INVENTION

The object of the invention is to propose a fan rotor as described in the introduction in which the axial position of the blades is controlled by a device that is simple and of low cost, without leading to problems when assembling or removing blades in the event of performing repairs.

According to the invention, this object is achieved by the fact that the upstream flange plate is fitted on its downstream face with resilient means for exerting sufficient force on the upstream faces of the blade roots, after assembly, to prevent any axial displacement of the blades during normal operation of the engine. The term "normal" operation of the engine is used to mean operation apart from exceptional events, of the type where foreign bodies are ingested or blades are lost.

Thus, once the rotor has been assembled, these resilient means exert sufficient force on the blade roots to ensure that they are held positively pressed against the upstream flange plate, thereby eliminating any axial assembly clearance regardless of the manufacturing tolerances of the blades.

Advantageously, that resilient means specific to each blade root are provided. These independent resilient means are preferably constituted by elastomer pegs held in respective orifices formed in the flange plate.

When the fan rotor further includes a spacer interposed between each blade root and the bottom of the corresponding groove, said spacer including a radially-extending lug pressing against the upstream face of said blade root, the resilient means advantageously bear against said lugs.

BRIEF DESCRIPTION OF THE DRAWINGS

Other advantages and characteristics of the invention appear on reading the following description given by way of example and with reference to the accompanying drawings, in which:

FIG. 1 is a diagrammatic section of a fan rotor;

FIG. 2 is a detailed view of the disposition of the upstream flange plate and a blade, showing the assembly clearance;

FIG. 3 is a view similar to FIG. 2, showing the clearance taken up by a peg;

FIGS. 4A and 4B are perspective views of a peg; and

FIG. 5 is a perspective view of the downstream face of the upstream flange plate fitted with its pegs.

MORE DETAILED DESCRIPTION

FIG. 1 shows a fan rotor 1 of axis X comprising a disk 2 and a plurality of blades 3 regularly spaced apart angularly around the axis X and extending radially outwards from the periphery of the disk 2. Each blade 3 has a blade root 4 which is retained in a groove or slot 5 that extends substantially axially in the rim of the disk 2. The blade roots 4 are of dovetail shape and the grooves 5 are of complementary shape. Under the action of centrifugal forces, when the fan is in operation, said blade roots 4 are held in the grooves 5 by the radially outer walls of the grooves 5.

A spacer 6 is disposed between the base of each blade root 4 and the bottom of the groove 5. At its end adjacent to the upstream face 7 of the disk 2, the spacer 6 has a lug 8 which bears against the upstream face 9 of the root 4 of the blade 3. The function of the spacer 6 is to prevent the blade 3 from dropping into the groove 5 when the fan is stationary, and to absorb a portion of the energy in the event of an impact against the blade, e.g. following ingestion of a foreign body, or breakage of an adjacent blade.

On the downstream face 10 of the disk 2 there is secured a downstream flange plate 9 against which the roots 4 of the blades 3 come into abutment.

An upstream flange plate 12 is also provided on the upstream face 7 of the disk 2 for the purpose of preventing the roots 4 of the blades 3 from sliding out from the grooves 5 once the rotor 1 has been assembled. The upstream flange plate 12 is fixed to flange pieces of the disk 2 by means of bolts, so that it can be removed, should that be necessary in order to replace a blade 3.

In FIG. 2, it can be seen that clearance J exists between the lug 8 and the downstream face 13 of the upstream flange plate 12. The root 4 of the blade 3 can therefore move through an axial distance J in its groove 5, and that can lead to the rotor 1 becoming unbalanced, thereby generating vibration in operation.

In accordance with the invention, the upstream flange plate 12 has an orifice 15 in front of each blade root 4, which orifice holds the shank 16 of an elastomer peg 17, the peg 17 having a head 18 of diameter greater than that of the orifice 15, and of thickness not less than the clearance J. As shown in FIG. 3, the head 18 of the peg 17 is placed on the downstream face 13 of the upstream flange plate 12, and said head 18 is compressed between the downstream face 13 of the upstream flange plate 12 and the upstream face of the lug 8 of the spacer 6.

The peg 17 thus exerts elastic forces on the lug 8 in an axial direction. Since the lug 8 is pressed against the adjacent blade root 4, the root is continuously urged towards the downstream flange plate against which it remains in abutment. This simple disposition serves to control the axial clearance of the blades 3 and to prevent the blades 3 from moving axially in random manner.

FIGS. 4A and 4B are perspective views of the peg 17, and FIG. 5 is a perspective view of the downstream face 13 of the upstream flange plate 12.

The pegs 17 are naturally engaged in the upstream flange plate 12 prior to the flange plate being assembled to the disk 2. Reference 20 designates an orifice formed in the upstream flange plate 12 for the purpose of enabling it to be fixed to the flange pieces of the disk 2 by means of bolts. Tightening these bolts causes the heads 18 of the pegs 17 to exert sufficient compression force to prevent any subsequent axial displacement of the blades 3, as a function of the difference between the thickness of the heads 18 when at rest and the original assembly clearance J. This compression force may vary from one blade to another depending on the manufacturing tolerances of the blades 3 and of the pegs 17.

What is claimed is:

1. A fan rotor comprising a disk having a rim with a plurality of substantially axial grooves that are regularly spaced apart angularly, a plurality of removable blades extending radially outwards from the periphery of said disk, each blade having a blade root received in a respective groove, a downstream flange plate secured to said disk with the downstream faces of the blade roots being in abutment against said downstream flange plate, and a removable upstream flange plate secured to said disk for the purpose of retaining the blade roots in the grooves, wherein the upstream flange plate is fitted on its downstream face with resilient means for exerting sufficient force on the upstream faces of the blade roots, after assembly, to prevent any axial displacement of the blades during normal operation of an engine, wherein resilient means specific to each blade root are provided.

2. A fan rotor according to claim 1, wherein the resilient means specific to each blade root are constituted by an elastomer peg retained in an orifice formed in the upstream flange plate.

3. A fan rotor according to claim 1, further comprising a spacer interposed between each blade root and the bottom of the corresponding groove, the spacer having a radially-extending lug bearing against the upstream face of said blade root, and wherein the resilient means bear against said lugs.

4. A fan rotor comprising:

a disk having a rim with a plurality of substantially axial grooves that are spaced apart;

a plurality of blades extending radially outwards from said disk, each blade having a blade root in a respective groove;

an upstream flange plate configured to prevent the blade roots from sliding out of the grooves; and a plurality of axial spacers coupled to said upstream flange plate, each axial spacer being configured to prevent an axial displacement of one of the blades in a respective grooves, wherein each of said axial spacers comprises a peg in an orifice of the upstream flange plate, and wherein said peg is an elastomer peg.

5. A fan rotor according to claim 4, wherein said axial grooves are regularly spaced apart angularly.

6. A fan rotor according to claim 4, further comprising a downstream flange plate secured to said disk.

7. A fan rotor according to claim 6, wherein downstream faces of the blade roots are in abutment against said downstream flange plate.

8. A fan rotor according to claim 4, wherein said upstream flange plate is secured to said disk.

9. A fan rotor according to claim 4, wherein said upstream flange plate is removable.

10. A fan rotor according to claim 4, wherein said axial spacers are fitted on a downstream face of said upstream flange plate.

11. A fan rotor according to claim 4, wherein each of said axial spacers is configured to exert sufficient force on an upstream face of said one of the blades.

12. A fan rotor according to claim 11, wherein each of said axial spacers is configured to exert said sufficient force during normal operation of said fan rotor.

13. A fan rotor according to claim 4, further comprising a root spacer interposed between each blade root and a bottom of a corresponding groove.

14. A fan rotor according to claim 13, wherein the root spacer has a radially-extending lug bearing against an upstream face of said blade root.

15. A fan rotor according to claim 14, wherein each of said axial spacers bears against one of said lugs.

16. A fan rotor according to claim 14, wherein each of said axial spacers comprises a shank in an orifice of the upstream flange plate and further comprises a head of diameter greater than that of said orifice.

17. A fan rotor according to claim 16, wherein the head of each of said axial spacers has a thickness not less than a clearance between said lug and a downstream face of the upstream flange plate.

18. A fan rotor according to claim 4, wherein each of said axial spacers has a portion located between said disk and a downstream face of the upstream flange plate.

19. A fan rotor according to claim 18, wherein said portion is compressed between said disk and said downstream face of the upstream flange plate.

20. A fan rotor comprising:

a disk having a rim with a plurality of substantially axial grooves that are spaced apart;

a plurality of blades extending radially outwards from said disk, each blade having a blade root in a respective groove;

an upstream flange plate configured to prevent the blade roots from sliding out of the grooves;

a plurality of axial spacers coupled to said upstream flange plate, each axial spacer being configured to prevent an axial displacement of one of the blades in a respective groove; and a root spacer interposed between each blade root and a bottom of a corresponding groove, wherein the root spacer has a radially-extending lug bearing against an upstream face of said blade root, and wherein each of said axial spacers comprises a shank in an orifice of the upstream flange plate and further comprises a head of diameter greater than that of said orifice.

* * * * *